US006401391B2

(12) United States Patent
Gabriele

(10) Patent No.: US 6,401,391 B2
(45) **Date of Patent: *Jun. 11, 2002**

(54) LOUVER CONTROL IN A MOVABLE LOUVER ASSEMBLY

(75) Inventor: Angelo Gabriele, Woodbridge (CA)

(73) Assignee: Vinylbiltshutter Systems Inc., Concord (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/274,868

(22) Filed: Mar. 23, 1999

Related U.S. Application Data

(63) Continuation-in-part of application No. 08/990,433, filed on Dec. 15, 1997, now abandoned.

(51) Int. Cl.[7] ..... E06B 7/086; E06B 7/08

(52) U.S. Cl. ..... 49/87.1; 49/74.1

(58) Field of Search ..... 49/51, 62, 74.1, 49/87.1, 359, 403; 211/202; 403/326, 104

(56) References Cited

U.S. PATENT DOCUMENTS

| | | | | | |
|---|---|---|---|---|---|
| 534,076 | A | * | 2/1895 | McFarland | 49/87.1 |
| 1,324,973 | A | * | 12/1919 | McQueen | 49/87.1 X |
| 1,960,763 | A | * | 5/1934 | Waddell et al. | 49/87.1 |
| 2,164,814 | A | * | 7/1939 | Griffith | 49/87.1 |
| 2,577,072 | A | * | 12/1951 | Cotner | 49/87.1 X |
| 3,691,687 | A | * | 9/1972 | Economou | 49/74.1 |
| 4,497,413 | A | * | 2/1985 | Tocci | 211/202 |
| 5,588,766 | A | * | 12/1996 | Lai | 403/104 X |
| 5,775,399 | A | * | 7/1998 | Shields, Jr. | 49/74.1 X |

* cited by examiner

*Primary Examiner*—Daniel P. Stodola
*Assistant Examiner*—Hugh B. Thompson

(57) ABSTRACT

A louver assembly comprises a plurality of parallel horizontally extending louvers pivotally secured at their opposite ends to a supporting frame and a control bar which determines angled positioning of the louvers. The control bar has a modular construction in that it is formed by a plurality of bar segments, that interlock, vertically aligned with one another. Each bar segment pivotally connects to an associated louver such that all of the louvers move in unison through a single movement of the control bar.

2 Claims, 9 Drawing Sheets

LOUVER CONTROL IN A MOVABLE LOUVER ASSEMBLY

This application is a continuation-in-part of U.S. patent application Ser. No. 08/990,433 now abandoned.

FIELD OF THE INVENTION

The present invention relates to a control for determining angled positioning of a set of louvers in a movable louver assembly.

BACKGROUND OF THE INVENTION

Shutters having movable louvers are becoming more and more popular as window coverings. When movable louver shutters were first introduced to the marketplace, they were generally made of wood. A control bar was loosely attached by staples to each of the louvers centrally of the shutter. The louvers were then opened or closed simultaneously with one another through the use of the control bar. The wood to wood contact at the ends of the louver with the surrounding frame would generally hold the position in which the louvers were set by the control bar.

More recently, plastic material such as vinyl and the like has been used as a replacement for wood in building movable shutter assemblies. The plastic material has the benefit of being more durable and more easily cleaned than wood.

When working with plastic, it has again been the norm to build a one piece control bar attached by loose fasteners to the individual louvers generally centrally of the shutter. However, because of the weight of the control bar and the relatively low co-efficient of friction at the interface between the louver ends and the surrounding frame, it is usually the case that some type of additional louver tensioning system is required. This tensioning system is generally built within the supporting frame engaging the louver ends where they enter the frame.

Again, in accordance with conventional plastic construction, the control bar is formed from an elongated extrusion and then cut to a specific length according to the height of and the number of louvers used in the shutter. The attachment of the control bar generally requires some type of an opening to be cut into the main body of the louvers to interfit a fastener between the control bar and the louvers.

SUMMARY OF THE INVENTION

The present invention provides a louver control system used in a movable louver assembly. The system includes a control bar formed from a plurality of bar segments, one for each louver. The bar segments are interlocked vertically aligned with one another to build the control bar in which each individual bar segment is pivotally secured to an associated louver.

In accordance with the present invention, the control bar is quickly and easily built at the same time that the shutter is assembled with the number of segments used in the control bar being determined by the number of louvers provided in the shutter.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
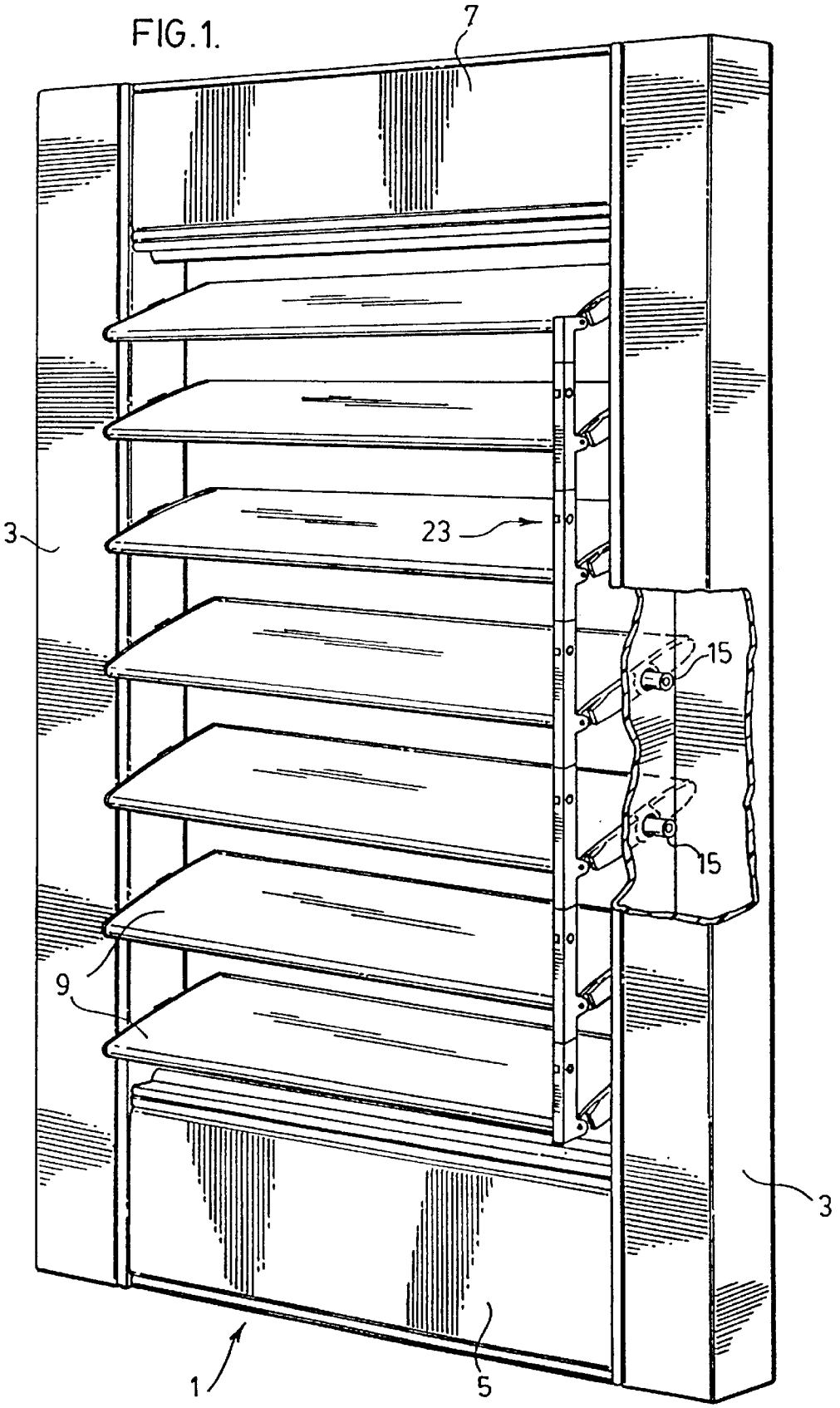
FIG. 1 is a perspective view of a movable louver assembly with the louvers open in accordance with a preferred embodiment of the present invention.

FIG. 1 shows a movable louver assembly and specifically a shutter generally indicated at 1. This shutter comprises a supporting frame formed by side jambs 3, a bottom sill 5 and a top header 7. As seen in FIG. 1, jambs 3 are substantially hollow.

A plurality of movable louvers 9 are pivotally held within the frame. The louvers present rounded louver pins at their opposite ends These louver pins pass through rounded openings on the interior sides of the frame jambs to allow the pivotal movement of the louvers.

Figure 3:
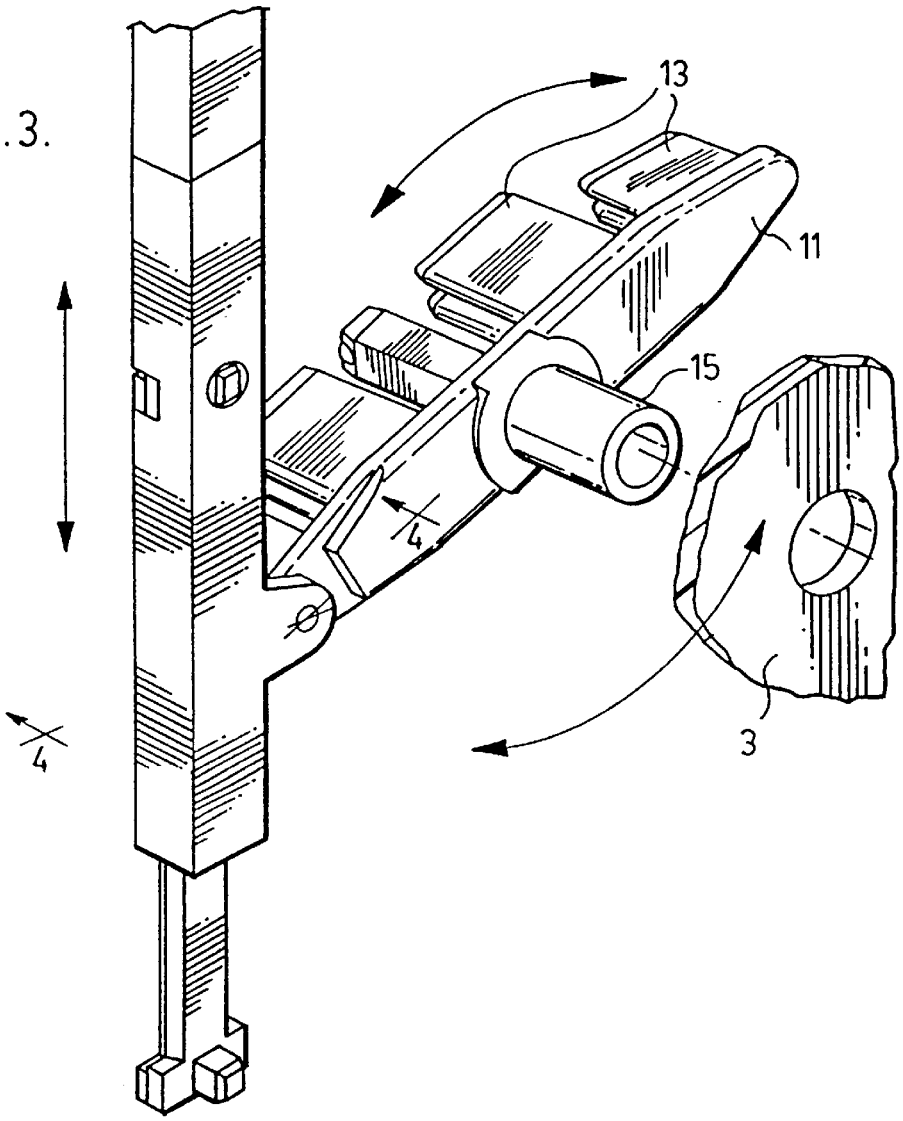
FIG. 3 is an enlarged perspective view of a section of the control bar and its attachment to a louver end cap from the assembly of FIGS. 1 and 2.

The opposite ends of the louvers 9 are provided with end caps from which the louver pins project. One such end cap 11 is well shown, for example, in FIGS. 3 and 5 of the drawings. This end cap includes prongs 13 to its one side with louver pin 15 to the other side of the end cap. The louvers themselves are generally hollow thus allowing prongs 13 to be forced into the end of the louver locking the end cap in position.

In the preferred embodiment of the invention, the entire louver assembly is made from extruded plastic e.g. vinyl material. The vinyl material provides not only durability but in addition allows consistency of the molded parts. This in turn and along with the resiliency of the vinyl allows pieces such as the end caps 11 as well as the bar segments to be described later in detail to be snap fitted into position during assembly of the shutter. Furthermore, if any of the various different parts are damaged, they can easily be snapped out of position and replaced with new parts.

Figure 4:
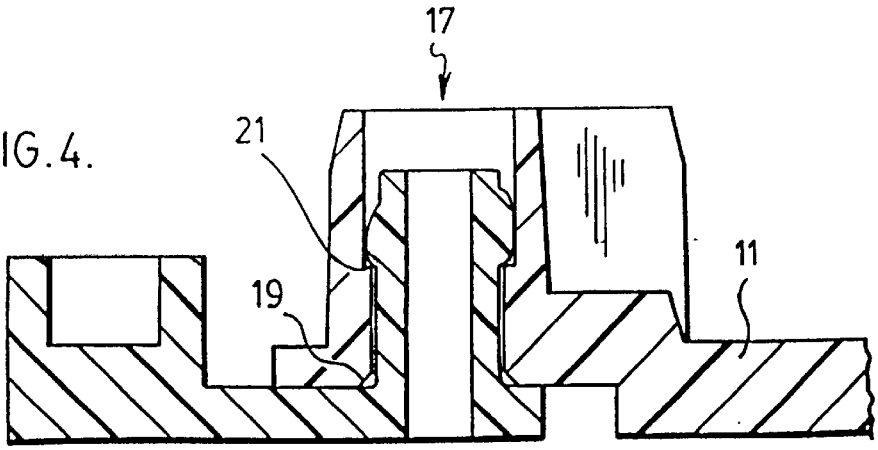
FIG. 4 is a sectional view showing the pivotal attachment of the bar segment to the louver end cap of FIG. 3.

Returning once again to FIG. 5, it will be seen that the louver cap 11 has an elongated configuration terminating with narrow tips at the opposite ends of the louver cap. One of these tips is provided with a bore or through passage generally indicated at 17. As is well shown in FIG. 4 of the drawings, passage 17 is defined by a tapered mouth 19 leading to the main body of the passage. An undercut lip 21 is formed interiorly of the passage.

Figure 7:
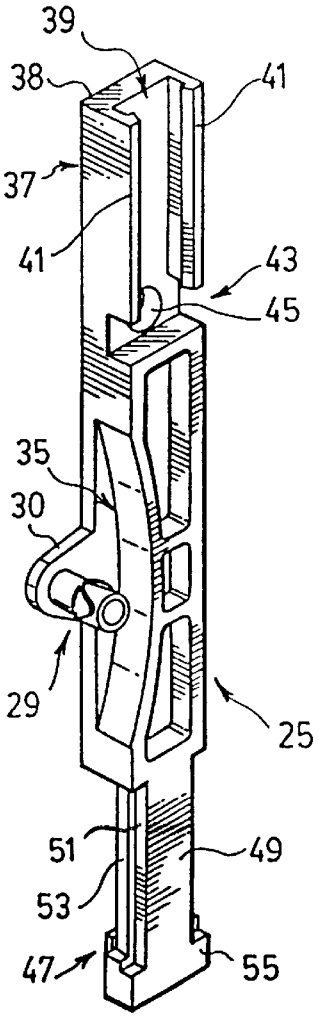
FIG. 7 is a further enlarged perspective view of one of the bar segments from the control bar section of FIG. 6.

Control for the angled positioning of the louvers 9 is provided by means of a control bar generally indicated at 23 in FIG. 1. This control bar is formed from a plurality of bar segments generally indicated at 25 in FIGS. 5 and 7. All of the bar segments 25 in the control bar 23 are identical to one another. They are snap fitted together held vertically aligned with one another. There is a bar segment for each louver and therefore the number of bar segments equals the number of louvers. This saves having to build and store a long length of control bar material and also saves having to accurately cut the control bar to fit with a shutter of a specific height.

Figure 1A:
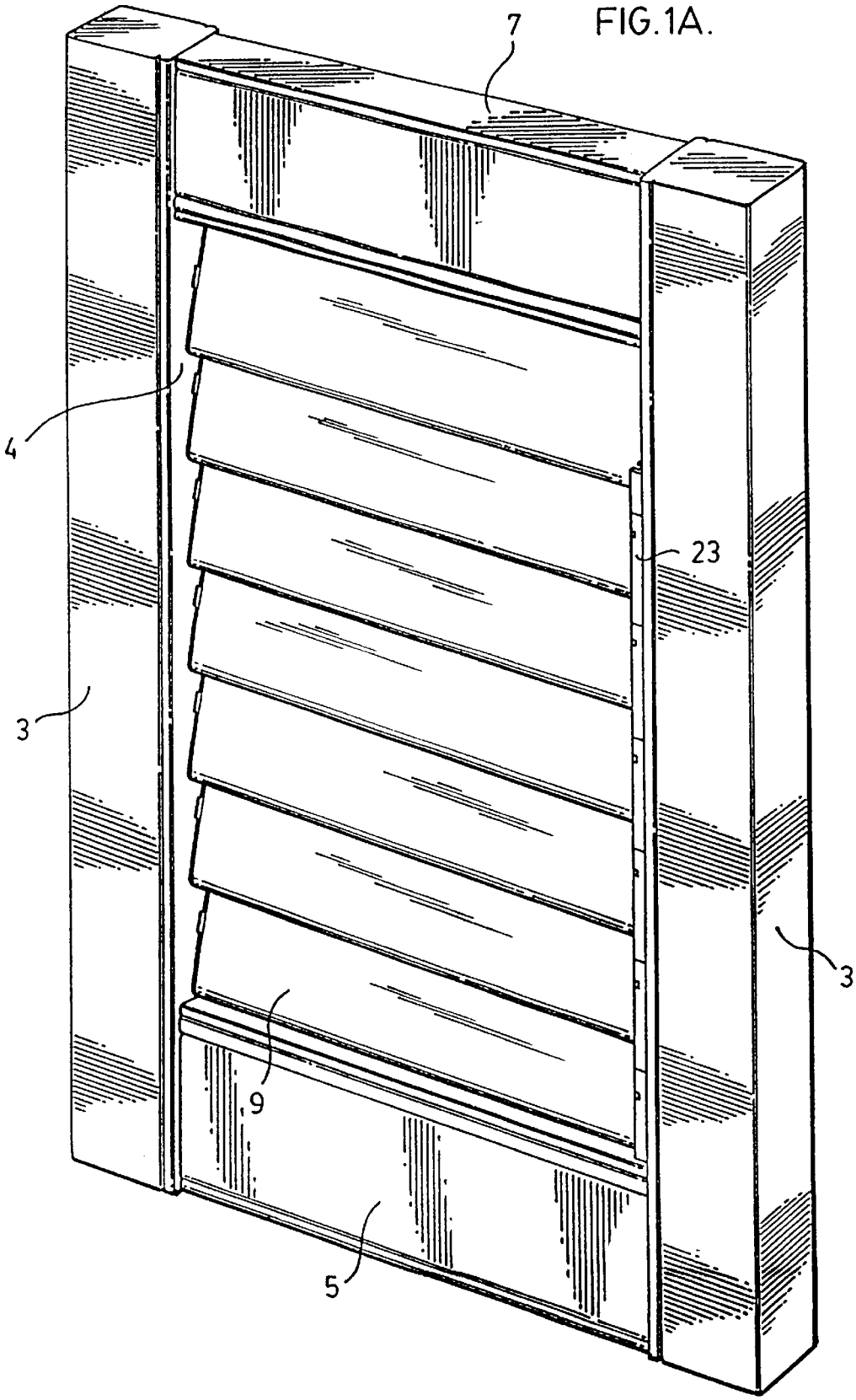
FIG. 1A is a perspective view of the louver assembly of FIG. 1 with the louvers closed.

In FIG. 1, it will be seen that the control bar 23 is straight because of the locked alignment of the bar segments. The control bar projects out from the louvers when the louvers are in an open light position. When the louvers are closed as shown in FIG. 1A, the jambs 3 define the outer face of the shutter with the louvers being recessed relative to the jambs which overhang the louvers. This leaves a clearance space 4 between the outside face of the jambs and the louvers. Bar 23 sits in the clearance space against the faces of the closed louvers inwardly of the overhanging jamb allowing the shutter to be closed directly against a window surface or the like without interference from the control bar.

In terms of the actual construction of bar segment 25, it is formed with a female interlock or coupling component near its one end 37 and a male coupling or interlock component at its other end 47. A small extension 30 extends laterally about mid way between the opposite ends of the bar segment. A projecting post generally indicated at 29 is provided on the lateral extension 30.

Post 29 snap fits into the bore 17 in the tip of cap 11 to provide a pivotal connection between the bar segment and the louver cap. Again, the use of plastic material makes it easy to snap the post into the opening. A recess 35 is provided beside post 29 for clearance of the tip of the louver end cap.

Figure 9:
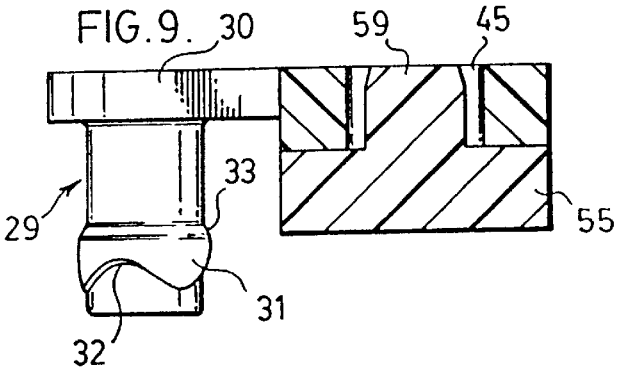
Figure 10:
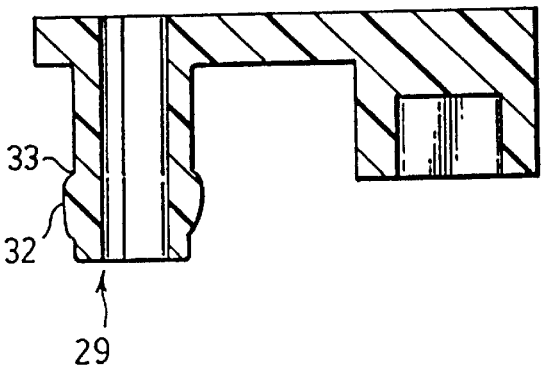

Post 29 as best seen in FIGS. 9 and 10 of the drawings is provided with a raised region 31 having a fluted or waved edge 32 on its front face and a reduced diameter neck 33 on its back face. The post is pushed into bore 17 with the initial fitting being aided by the angled bore mouth 19. The raised region 31 on the post is forced into the bore until the reduced neck 33 of the post locks behind undercut lip 21 interiorly of the bore. The fluted edge 32 on the raised post region 31 eliminates some of the post material in this area allowing it to more easily forced into the bore. There is a noticeable snap as the post locks in the bore.

Although post 29 is pivotally locked in bore 17 there is some frictional resistance to the pivoting action of the post. The bar segment itself is quite small and this frictional resistance is sufficient to support the weight of the bar segment. This feature, along with the cooperation of all of the bar segments with one another over the length of the control bar, ensures that the louvers, when set to any desired angle, will be held in position by the control bar without requiring tensioners to be built in the side jambs of the frame. Therefore, the modular construction of the control bar is not only very efficient, but in addition, substantially reduces manufacturing costs of the shutter with respect to the control bar and also by eliminating additional tensioners.

The snapping together of the bar segments is achieved by pressing the male end 47 of one bar segment into the female end 37 of an adjoining bar segment. The male end 47 has a main body portion 49 recessed at 51 to its opposite sides to provide a ledge portion 53 behind the recess. A wider head 55 is provided at the extreme outer end of the male end of the bar segment. This head is provided with a locking post 57.

Figure 5:
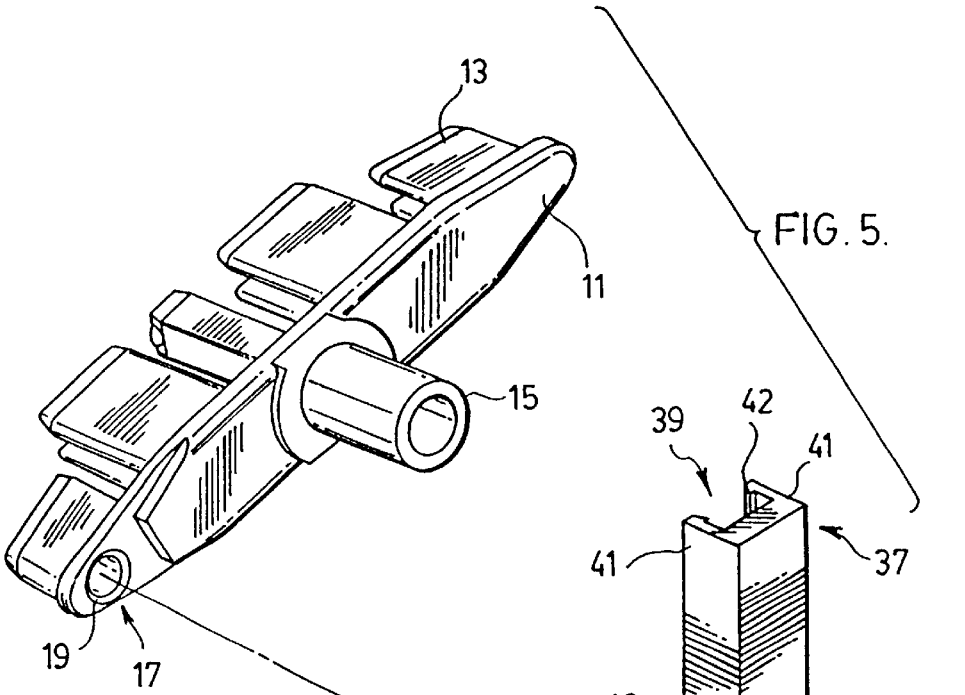
FIG. 5 is an exploded perspective view of the bar segment and louver end cap of FIG. 3.

The female end 37 of the bar segment includes a central channel 39 bordered to either side by relatively flexible legs 41. Each of these legs is provided with a foot 42 having a cammed front face and an undercut back face as best seen in FIG. 5. A slot 43 is provided across the female end of the bar segment and an opening 45 is provided through the bar segment aligned with slot 43.

The main body portion 49 of the male end of the bar segment is pressed into channel 39 of the female end of an adjacent bar segment. The cammed front faces on the feet 42 of the legs 41 of the female end of the bar segment cause the legs to spread slightly allowing the male end to move into channel 39. Once the male and female components are fully interlocked, the undercut back faces of the feet 42 on the female coupling component, lock against the ledges 53 of the male locking component. The enlarged head 55 on the male locking component seats in slot 43 of the female locking component as guided by post 57 which locks into opening 45.

Again there is a noticeable snap locking as the male and female interlock components reach the interlock position so that someone assembling the control bar knows that the fitting has been completed. Furthermore, the elongated T-shaping of the interlock of the bar segments as described above ensures that they are held aligned with one another to keep the control bar straight regardless of its length. The straightness of the control bar in turn assures that it will be effectively hidden beside the jamb when the louvers are closed.

As noted above, the various different parts of the shutter are preferably extruded which results in accurate shaping of the parts. However, even using extrusion processes, some variances can occur in the length of the bar segments from one bar to the next. These variances may, for example, be caused by different batches of plastics material or by different operating speeds of the extrusion equipment.

If there are length variances from one bar segment to the next, the louvers do not lie parallel to one another when connected to the control bar which adversely affects both the aesthetics and the performance of the shutter.

Figure 11:
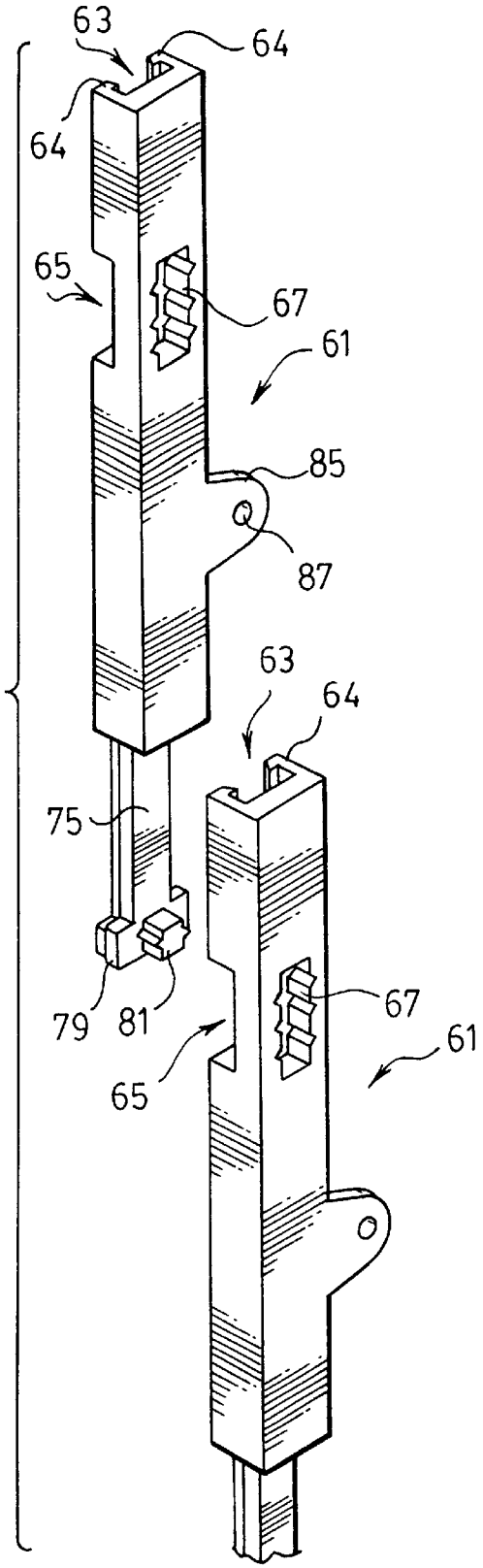
FIG. 11 is an exploded perspective view of part of an adjustable length control bar made from bar segments according to a further preferred embodiment of the invention.

The bar segments 61 of FIG. 11 have been specifically designed to overcome all of the above potential difficulties.

Like the earlier described bar segments, bar segments 61 have an upper end T-shaped recess formed by a first recess portion 63 and a second recess portion 65 at right angles to the first recess portion. The first recess portion 63 is bordered by lips 64 which define an undercut to either side of first recess portion 63.

As can be well seen in FIG. 11 each bar segment 61 has an open region 67 which penetrates completely through the bar segment aligned with the second recess region 65 of each bar segment.

The lower end of each bar segment is provided with a T-shaped male interlock component having a stem portion 75 and a head portion 79 at right angles to the stem portion. Head portion 79 is provided with a projecting post or lug 81.

Figure 12:
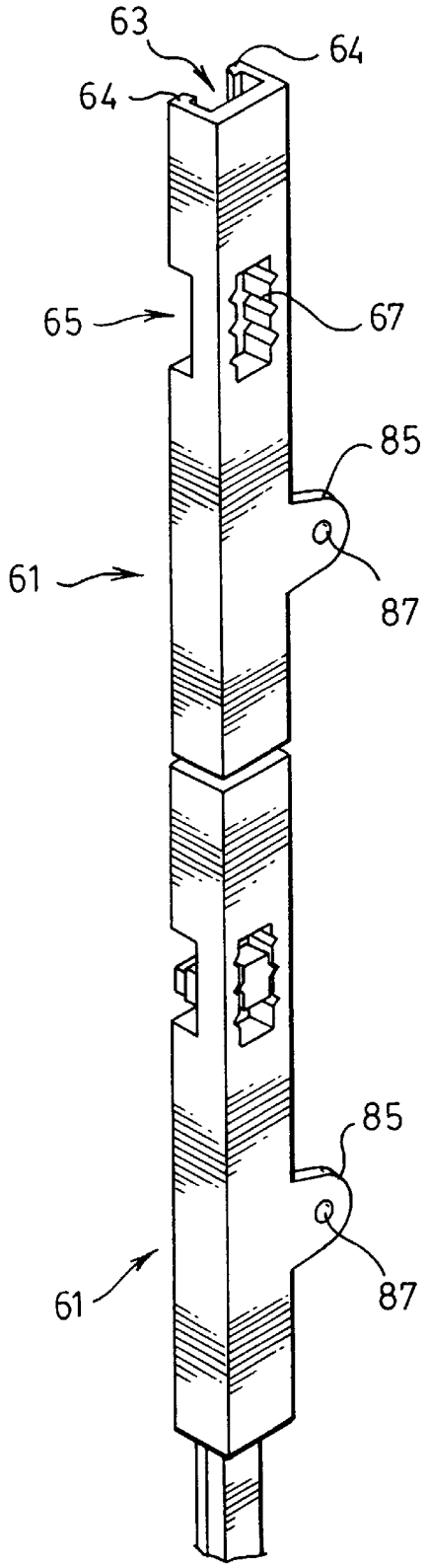
FIG. 12 is an assembled perspective view of the bar segments of FIG. 11.

As will be appreciated from FIG. 11, and as seen in FIG. 12, the male interlock component at the lower end of the upper bar segment fits into the female interlock component at the upper end of the lower bar segment. Specifically, stem portion 75 snap locks into first recess portion 63 while the head portion 79 locates within the second recess portion 65. The lug 81 on the head portion 79 fits into opening 67.

Figure 6:
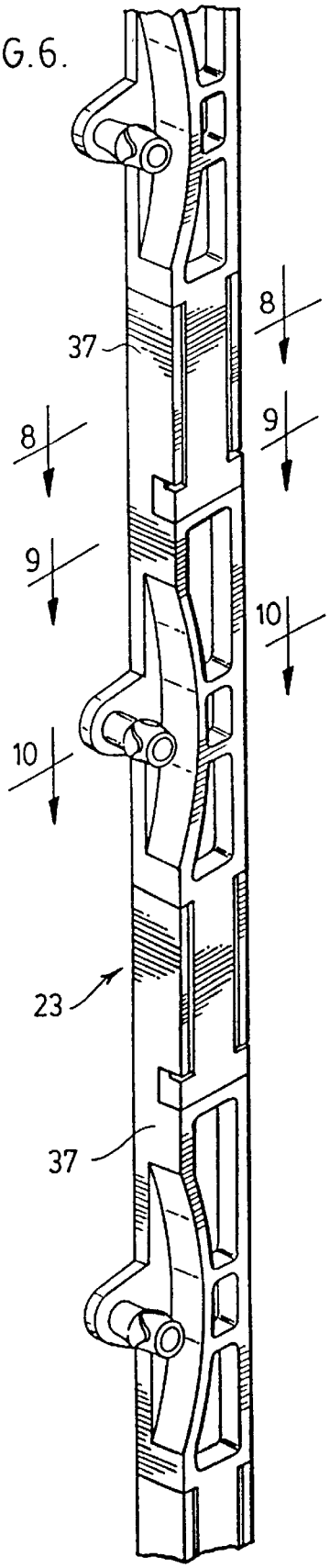
FIG. 6 is an enlarged perspective view of a section of the control bar of FIGS. 1 and 2.
Figure 8:
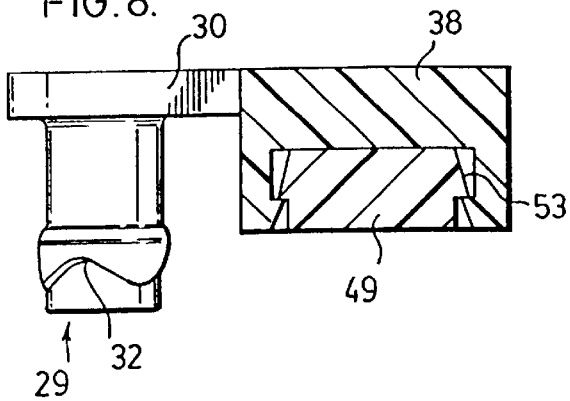
FIGS. 8, 9 and 10 are sectional views along the lines 8—8, 9—9 and 10—10 of FIG. 6.
Figure 13:
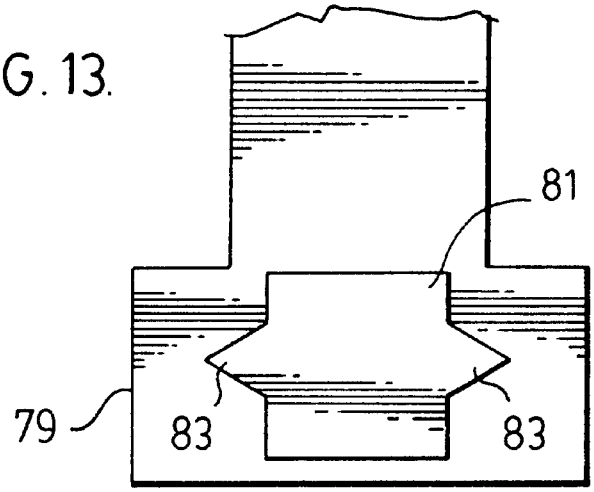
FIG. 13 is an enlarged front view of the louver end of one of the bar segments of FIG. 11.
Figure 14:
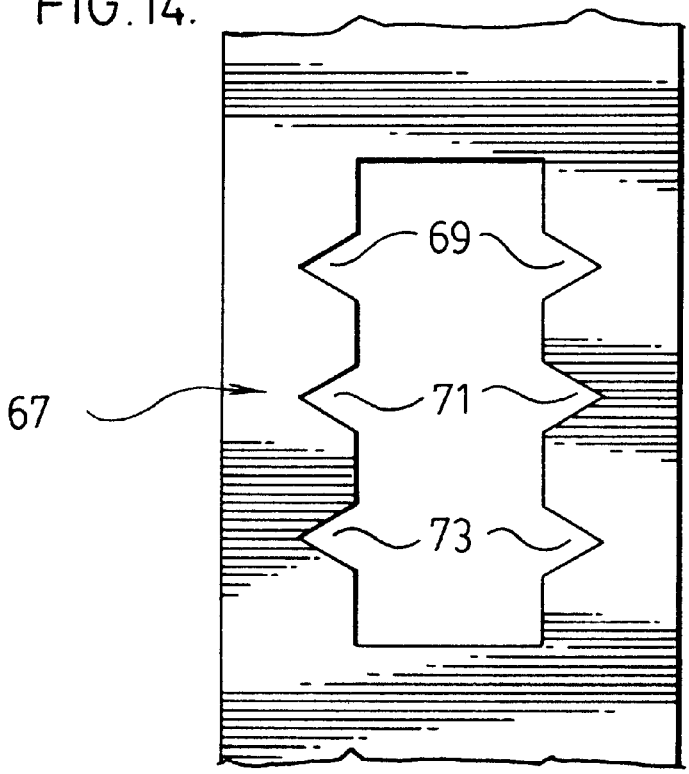
FIG. 14 is an enlarged front view of the upper end of one of the bar segments of FIG. 11.

The interlock action, described immediately above, is identical to the interlock action, shown for example in FIG. 6 of the drawings. However, FIGS. 13 and 14 reveal an additional feature of bar segments 61 not found in bar segments 25. Specifically, as seen in FIG. 13 the post 81 on head 79 of the male interlock component is provided to its opposite sides with teeth 83. Furthermore, as shown in FIG. 14, the opening 67 through the bar segment aligned with recess portion 65 is elongated relative to post 81 and is additionally provided with different sets of notches 69, 71 and 73.

Figure 15:
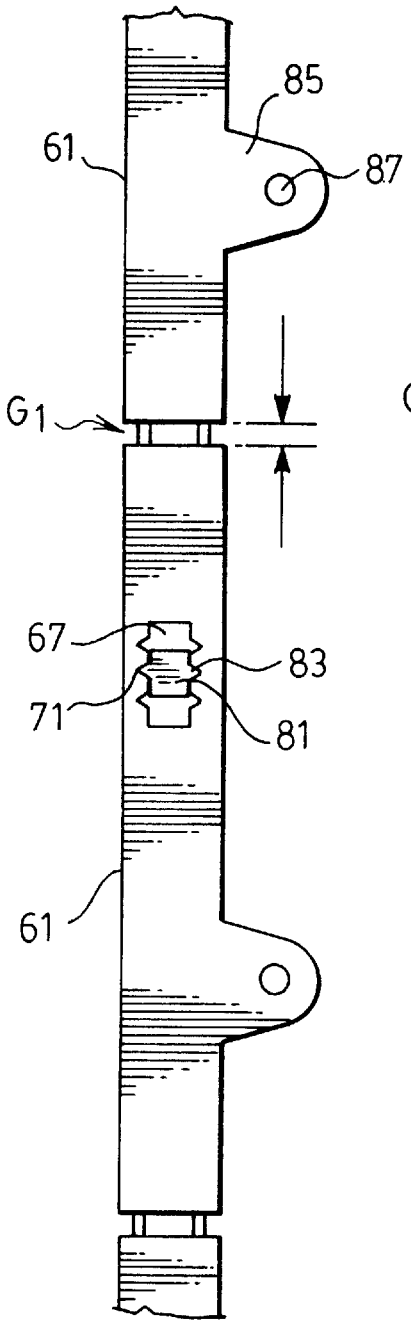
FIGS. 15 through 17 are front views of the two bar segments of FIG. 11 in various different mounting positions relative to one another.
Figure 16:
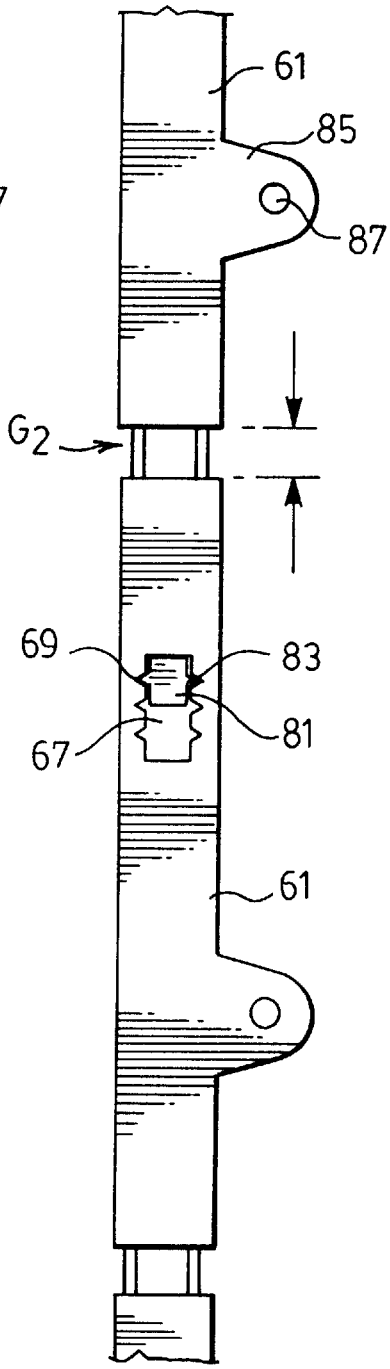
Figure 17:
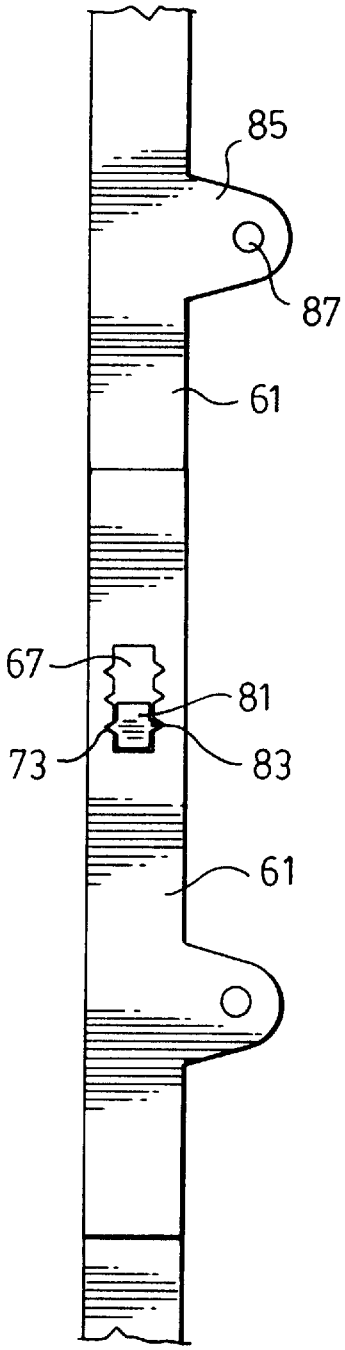

As will be seen in FIGS. 15 through 17 of the drawings, the two bar segments are interlockable in any one of three different positions. FIG. 15 shows the intermediate position in which post 81 interlocks centrally of opening 67. In this position, the teeth 83 to either side of the post are trapped within the teeth receiving recesses or notches 71 of opening 67. This leaves a slight gap G1 between the main body portions of the two bar segments 61.

FIG. 16 shows interlocking of the two bar segments 61 for the most extended length of the two bar segments. In this mounting position, the post 81 of the upper bar segment locates in the upper region of opening 67 in the lower bar segment. The teeth 83 on post 81 lock into the notches 69 of the opening.

In the FIG. 16 position, there is a gap G2 between the main body portions of the two bar segments 61. It will be seen that gap G2 of the FIG. 16 mounting position is greater than the gap G1 of the FIG. 15 mounting position.

FIG. 17 shows the third mounting position where the post 81 of the upper bar segments sits in the lowermost region of the opening 67 in the lower bar segment. In this position, the teeth 83 on the post lock into the notches 73 of the opening.

In FIG. 16, it will be seen that there is no gap between the main body portions of the two bar segments. This is the shortest length created by snap connecting to bar segments to one another.

Figure 2:
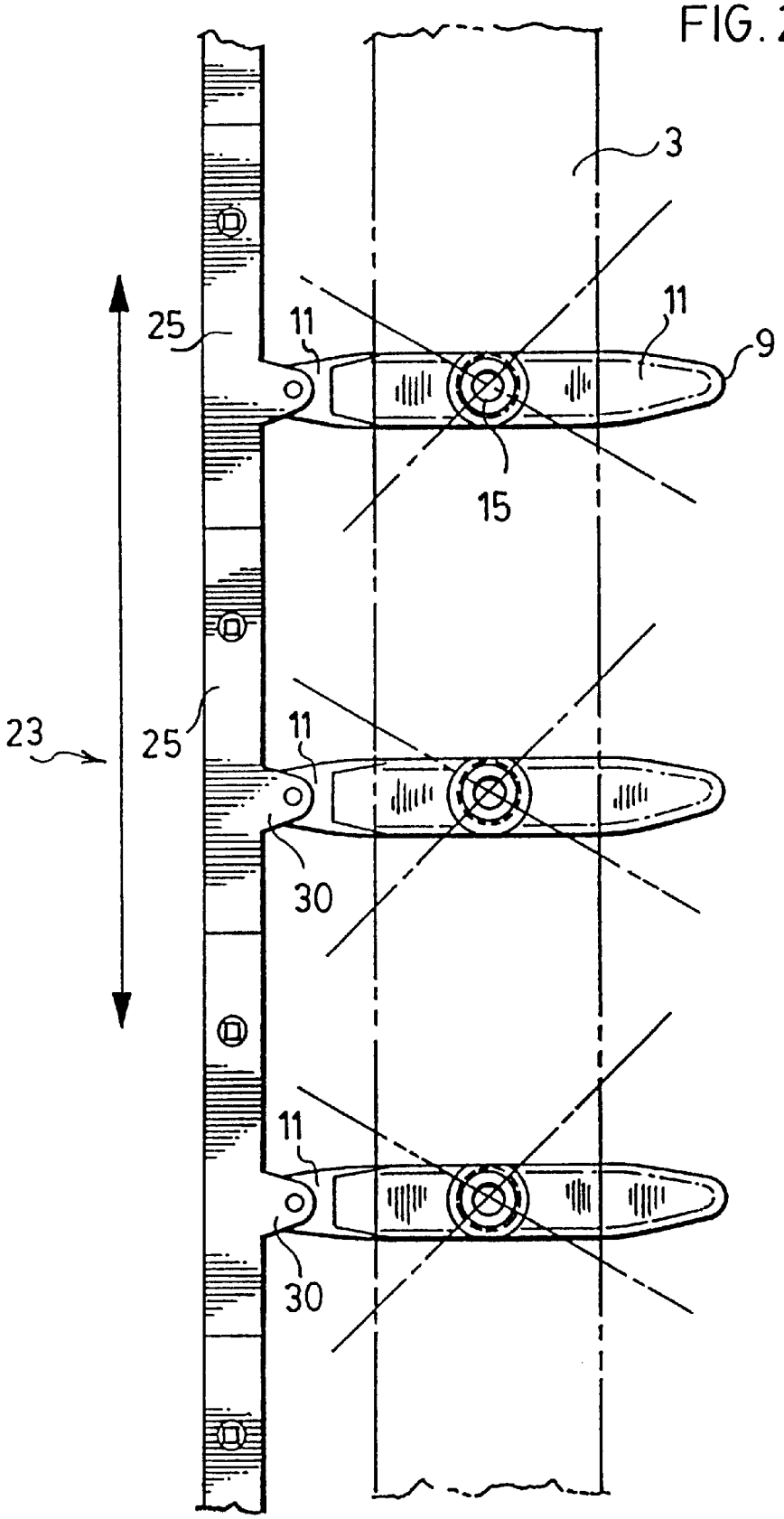
FIG. 2 is an end view of the assembly of FIG. 1.

Each of the bar segments is provided with a lateral projection 85 having a post 87. Lateral projection 85 and post 87 are identical to the lateral projections 30 with posts 29 of bar segments 25. The posts 87 are used to pivotally snap into the end caps of the movable louvers in the identical manner earlier described with respect to FIGS. 2 and 3 of the drawings.

It will be seen in comparing FIGS. 15 through 17 that the vertical positioning of lateral projection 85 and post 87 is varied according to the snap together mounting positions of the bar segments relative to one another, i.e. in FIG. 16 on the upper bar segment, the lateral projection and post is somewhat higher than the lateral projection and post in FIG. 15 and substantially higher than the lateral post and projection in FIG. 17.

According to preferred specifications of the invention, the total adjustment of each bar segment is a total of about 0.003 inches with about 0.0015 inches to either side of the center positioning. Such a tolerance is generally more than acceptable to take up manufacturing variances. However, as to be appreciated other tolerances could also be used to provide the desired adjustability of the control bar each bar segment.

The description above relates to an individual pair of teeth being provided on each post 81 and an individual set of notches for receiving those teeth. Again, it is to be appreciated that additional teeth can be provided on the teeth and a corresponding additional number of notches provided in opening 67 at each of the receiving locations for those teeth. Furthermore, more than the three different mounting positions shown can also be provided.

When working with the variable position interlock feature of the bar segments, each bar segment can be accurately aligned with its associated louver. For instance, some of the bar segments may be set in different mounting positions relative to other bar segments in order to achieve this alignment.

As will be understood from the above, the dismantling of any of the components can be achieved relatively easily by unsnapping the interlocks should any of the components need replacing.

Although various preferred embodiments of the present invention have been described in detail, it will be appreciated by those skilled in the art, that variations may be made without departing from the spirit of the invention or the scope of the appended claims.

What is claimed is:

1. A louver assembly comprising a plurality horizontally extending louvers pivotally secured at opposite ends thereof to a supporting frame, and a control bar which moves said louvers in unison to vary angled positioning of said louvers, said control bar being formed by a plurality of identical bars segments each of which has a vertically extending longitudinally axis, the bar segments being interlocked by interlocks on the bar segments which hold the bar segment axially aligned with one another, each bar segment having its own louver connector member laterally offset from the longitudinal axis thereof, each bar segment further having a pivotal connection to an associated one of said louvers at the louver connector member of each bar segment, the pivotal connector between each bar segment and each louver being provided by a snap fit coupling comprising a post which snap locks into a post opening, the post being locked against removal while being rotatable within the post opening, the post of the snap fit coupling being formed on the louver connector of each bar segment and the post opening being provided in an end cap of each louver.

2. A louver assembly comprising a plurality horizontally extending louvers pivotally secured at opposite ends thereto to a supporting frame and a control bar which moves said louvers in unison to vary angled positioning of said louvers, said control bar having a longitudinal axis and a plurality of louver connectors spaced from one another lengthwise of said bar, the louvre connectors being laterally offset from the longitudinal axis of the bar, each louver connector providing a pivotal connection to an associated one of said louvers by a snap fit coupling comprising a post which snap locks into a post opening, the post being locked against removal while being rotatable within the post opening, the post of the snap fit coupling being formed on the louver connector and the post opening being provided in an end cap of each louver.

* * * * *